United States Patent [19]

Roepke et al.

[11] 4,303,277

[45] Dec. 1, 1981

[54] TRIANGULAR SHAPED CUTTING HEAD FOR USE WITH A LONGWALL MINING MACHINE

[75] Inventors: Wallace W. Roepke, Excelsior; Sterling J. Anderson, Maple Grove, both of Minn.

[73] Assignee: The United States of America as represented by the Secretary of the Interior, Washington, D.C.

[21] Appl. No.: 118,959

[22] Filed: Feb. 6, 1980

[51] Int. Cl.[3] ..... E21 27/24

[52] U.S. Cl. ..... 299/43; 299/86

[58] Field of Search ..... 175/91; 299/42–53, 299/87, 89, 91

[56] References Cited

U.S. PATENT DOCUMENTS

| | | | |
|---|---|---|---|
| 2,572,403 | 10/1951 | Stevenson | 299/90 X |
| 2,825,544 | 3/1958 | Ahlson | 175/91 X |
| 3,407,006 | 10/1968 | Brill et al. | 175/91 X |
| 3,558,194 | 1/1971 | Renzing et al. | 299/87 |
| 4,012,077 | 3/1977 | Roepke et al. | 299/89 X |
| 4,062,595 | 12/1977 | Roepke et al. | 299/18 |
| 4,074,778 | 2/1978 | Morrell et al. | 299/87 X |

*Primary Examiner*—Ernest R. Purser

*Attorney, Agent, or Firm*—Thomas Zack; Donald A. Gardiner

[57] ABSTRACT

A longwall mining machine comprises a rotatable cutting head having a configuration in the form of an equilateral triangle viewed along its axis of rotation and formed with a continuous auger along the outer surface of the head. Cutter bits are located on apexes of the auger. The cutting head is mounted on a boom adjacent the longwall and is geared to produce an eccentric Cardan motion to the head causing the cutter bits to follow a substantially square trajectory in a plane normal to the axis of rotation of the head. Production of coal dust is minimized by deep linear vertical and horizontal cuts extending downwardly from roof to floor. During rotation of the head, cut coal is augered outwardly from the longwall and dropped into a conveyor for removal to a collection area.

5 Claims, 7 Drawing Figures

TRIANGULAR SHAPED CUTTING HEAD FOR USE WITH A LONGWALL MINING MACHINE

TECHNICAL FIELD

The present invention relates generally to longwall mining machines and more particularly toward a method of and apparatus for minimizing production of coal dust and for increasing productivity during longwall mining.

BACKGROUND ART

Mechanization of coal mining having become prevalent within about the last 50 years has virtually eliminated manual mining techniques. The greatest increase in productivity has been obtained since the late 1940's with the design and development of rotary head mining machines which use a number of bits on a rotating drum that is advanced into the coal face or reciprocated vertically to fragment the face. Two lines of evolutionary development have been pursued; one line has produced continuous mining machines characterized by wide drum type heads mounted on a yoke or boom supported on a mobile vehicle. The other line has produced a drum type machine generically termed a longwall mining machine which uses a narrower drum mounted on a single arm supporting the drum on a cantilevered shaft. The drum and support are mounted on a track adjacent the longwall.

A persistent problem encountered in mining operations is that of maintaining or increasing production while reducing generation of airborne respirable dust. U.S. Pat. No. 4,012,077, assigned to the assignee of the present invention, for example, discusses the problem of coal dust production and discloses a cutter unit having a triangular shaped drum type cutting head with cutter bits located on the apexes of the head. The head is driven in an elliptical eccentric path to cause the cutter bits to make box shaped cuts in the mine face during sump and shear cycles. In that patent, production of airborne coal dust is reduced, with an increase in productivity of coal. In U.S. Pat. No. 4,062,595, assigned to the common assignee, a method of making linear cuts in the mine face using the triangular cutting head shown in U.S. Pat. No. 4,012,077 as well as a new coal conveyor system to further reduce secondary dust generated by falling coal is disclosed. Details of the technique of linear cutting of mine faces to increase productivity and reduce production of coal dust are discussed in the two patents mentioned above and will not be repeated here for brevity; the disclosures of the two patents are incorporated herein by reference. The apparatus disclosed in these patents, however, are applicable only to continuous mining; there is no system to our knowledge for reducing coal dust production while increasing mining productivity in longwall mining machines.

One object of the present invention, therefore, is to provide a new and improved longwall mining machine capable of reducing coal dust generation while increasing productivity.

Another object is to provide a longwall mining machine using a linear cutting head undergoing eccentric rotary motion to provide deep linear cuts in a longwall face to reduce production of coal dust while increasing mining productivity.

Another object is to provide a cantilevered longwall mining machine which reduces production of coal dust by making constant depth linear cuts in a sidewall face.

DISCLOSURE OF INVENTION

A longwall mining machine, in accordance with the invention, comprises a chassis guided on a track parallel to and adjacent a longwall to be mined. One end of a boom is pivoted to the chassis for movement in a vertical plane. A rotatable cutting head is cantilevered from one side of the opposite end of the boom to be extended into the longwall for cutting. The head is in the form of an auger having a center shaft and continuous helix formed on the outer surface of the shaft. Each turn of the helix has a shape of an approximately equilateral triangle viewed from its axis of rotation with cutter bits being mounted on the apexes of the helix. The cutting head is coupled through idler wheels to a motor located at the lower end of the boom. Gearing is provided with the cutting head at the outboard end of the boom to cause the head to move in an eccentric elliptical path with the cutter bits describing a substantially square trajectory in a plane normal to the axis of rotation of the head.

The cutting head is moved into the face of the longwall during rotation and concurrent eccentric elliptical movement to remove coal by forming deep linear cuts. The cutter head is rotated with its surface adjacent the coal face moving downwardly to cause coal fragments to fall to the bottom of the cut. The longwall is cut in one or more passes of the cutter head along its entire length. During rotation of the cutter head, coal cut from the longwall face is augered away from the longwall to drop to a conveyor where the coal is transported to a remote collection area.

Still other objects and advantages of the present invention will become readily apparent to those skilled in this art from the following detailed description, wherein we have shown and described only the preferred embodiment of the invention, simply by way of illustration of the best mode contemplated by us of carrying out our invention. As will be realized, the invention is capable of other and different embodiments, and its several details are capable of modifications in various obvious respects, all without departing from the invention. Accordingly, the drawings and description are to be regarded as illustrative in nature, and not as restrictive.

BEST MODE FOR CARRYING OUT THE INVENTION

Figures 1, 4:
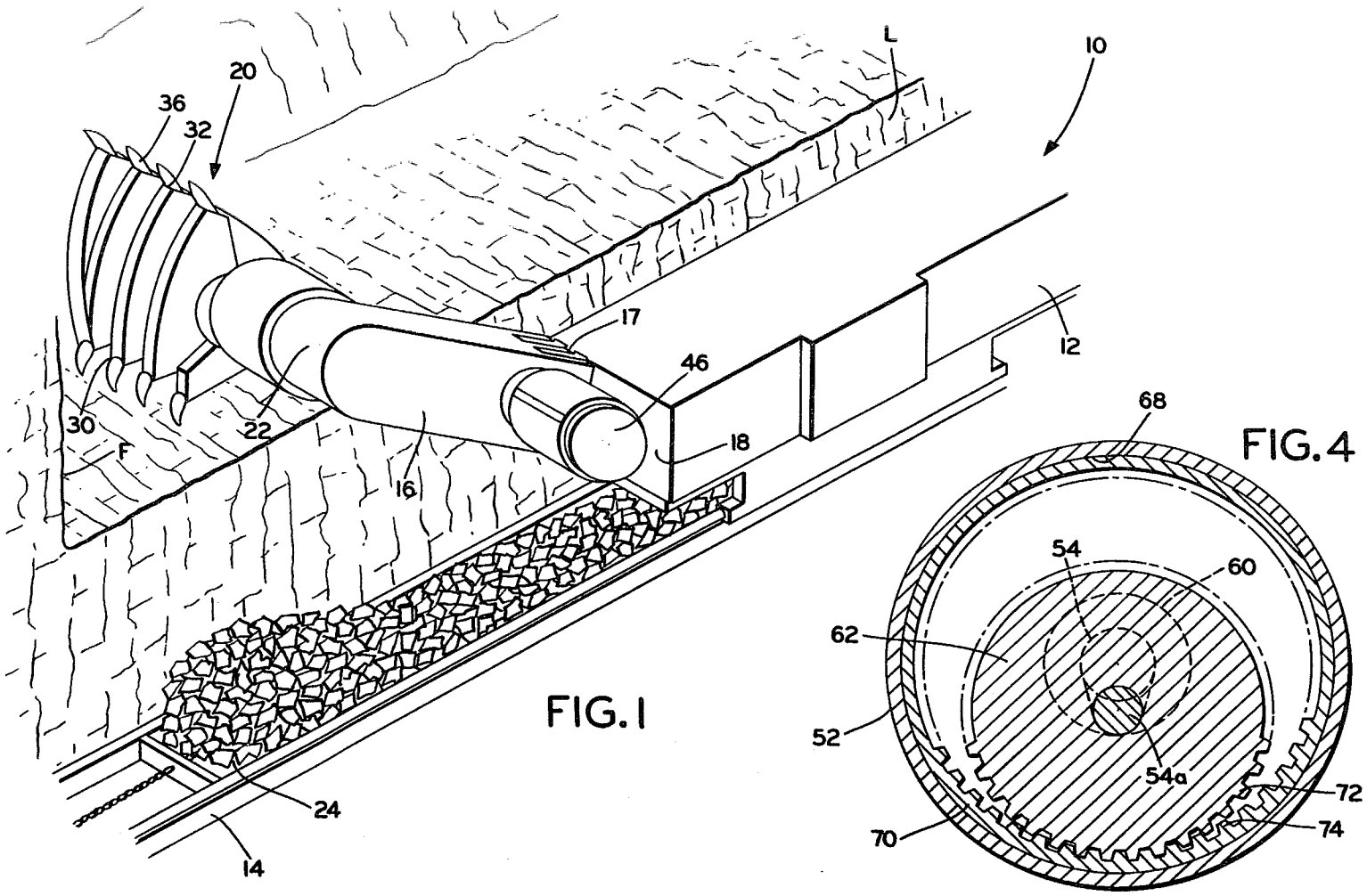
FIG. 1 is a perspective view showing the longwall mining machine including a cantilevered linear cutting rotary head and coal conveyor in accordance with the present invention.
FIG. 4 is a sectional view of a portion of the cutter head of FIG. 3 taken along the line 4—4.

Referring to FIG. 1, a longwall mining machine, designated generally by the numeral 10, comprises a chassis 12 mounted for movement on tracks 14 parallel to a longwall L to be mined. A boom 16 is pivotably supported to one end 18 of the machine 10 at hinge 17 to pivot in a vertical plane by conventional means (not shown) such as hydraulic cylinders of the type described in U.S. Pat. No. 4,012,077, supra. A rotatable cutter head 20 is cantilevered from one side of the boom 16 at outer end 22 to extend into the longwall L, as shown, to make cuts into the face F of the longwall to break up the coal for removal by a floor mounted belt or chain conveyor 24 (see also FIG. 2).

The rotary cutter head 20 comprises a rotary shaft 26 having formed to its outer surface a helix or auger 28 having a shape when viewed along its longitudinal axis approximately of an equilateral triangle having apexes 30, 32 (FIG. 1) and 34 (FIG. 3) and outwardly curved face regions defining a Realeaux triangle. As discussed in U.S. Pat. No. 4,074,788, assigned to the common assignee, the Realeaux triangle configuration is ideally suited for drilling a square hole since a characteristic of the configuration is that it can be enclosed within a square, and when rotated, one of its sides will always be in contact with a side of the square.

Figure 3:
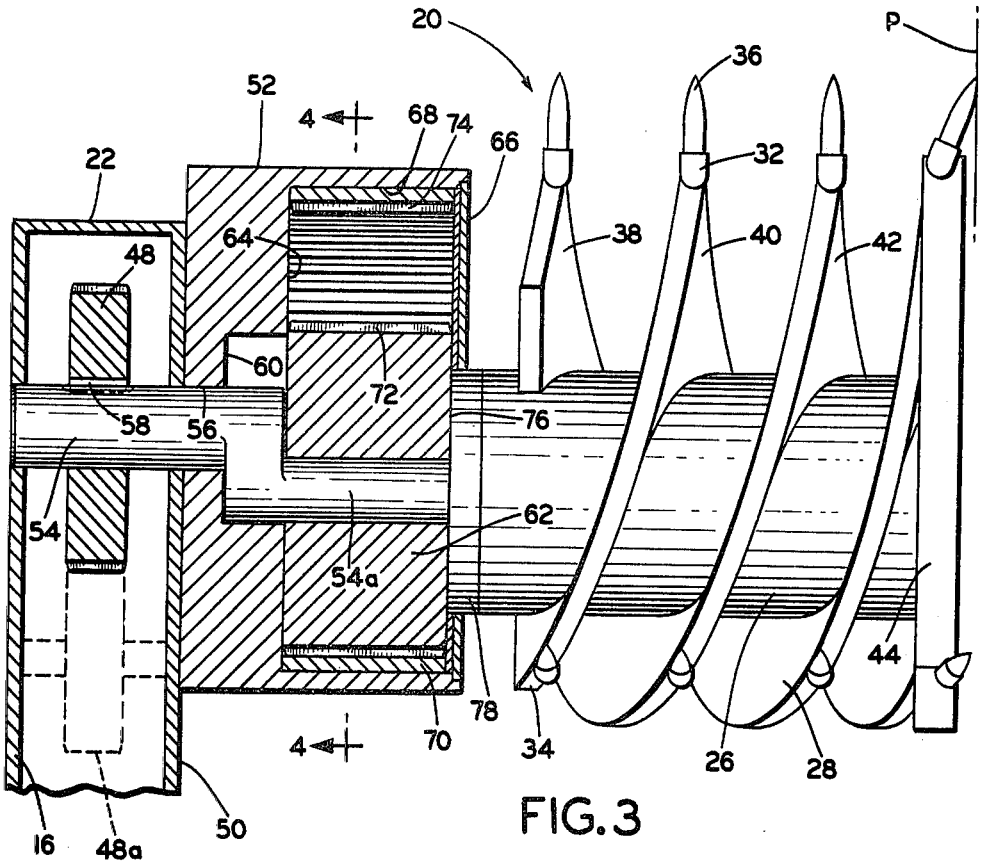
FIG. 3 is a top elevational view of a portion of the machine in FIG. 1, partially in section, illustrating the construction of the cutter head.

Each apex 30, 32 and 34 of the helix 28 carries a tapered cutting bit 36 for making vertical cuts into the longwall face F. The bits 36 on the inner helixes 38, 40 and 42 are oriented vertically whereas the bits on the outer helix 44 are skewed outwardly, as shown in FIG. 3. The cutting bits 36 on the inner helixes 38–42 make straight vertical cuts into the longwall face F to break up coal whereas the bits on the outer helix 44 make vertical skewed cuts to define a cutting plane P within the longwall.

Figure 2:
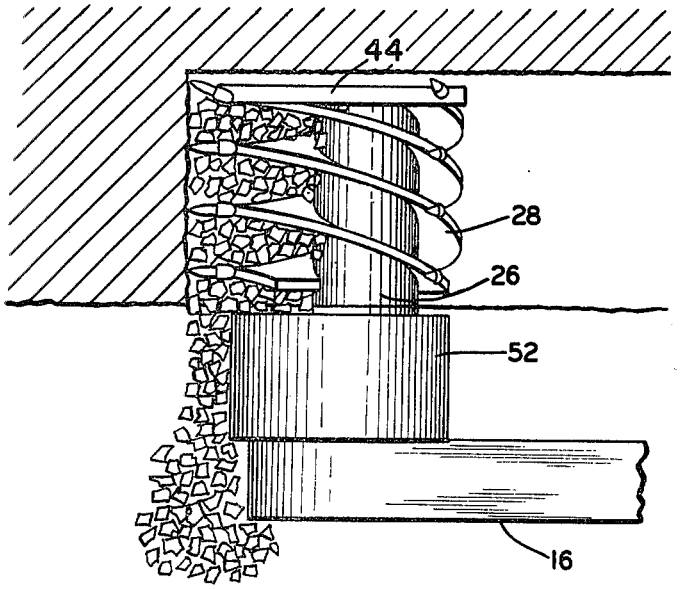
FIG. 2 is a top view of the rotary cutter head of FIG. 1 showing the auger for removing cut coal from the longwall to a floor supported conveyor.

In accordance with the invention, the cutter head 20 cantilevered from boom 16 is extended into the longwall L against the working face F and rotated by a motor 46 supported at the base of the boom 16. The motor 46 and cutter head 20 are coupled together through a series of idler gears such as 48*a* in FIG. 3 while internal gearing to be described in detail below causes the cutter bits 36 to describe a substantially square trajectory to make box cuts into the longwall face F. As coal is cut from the longwall L, by the machine 10 oriented parallel to the longwall surface, the coal pieces are conveyed outwardly from the longwall by auger 28 as shown in FIG. 2 to fall onto the conveyor 24 for removal to a collection area (not shown).

The structure and operation of the machine 10 of the present invention are similar in some respects to those shown in U.S. Pat. No. 4,012,077. The machine in the patent, however, is a continuous miner machine, rather than a longwall machine; the head is mounted perpendicular to the coal face being cut with the machine chassis pushing the head into the face and with cut coal falling to the floor ahead of the machine to be scooped by a relatively complex gathering mechanism. In accordance with the present invention, on the other hand, cutter head 20 is cantilevered transversely into the longwall and cutting is made from one side of the chassis 12 rather than on the longitudinal axis of the chassis as in the patent. Furthermore, whereas the surface of the cutter head defining the perimeter of the Realeaux triangle in the patent is formed as a continuous surface to constitute a drum, the corresponding portion of the cutter head 20 in accordance with the invention is in the form of a helix 28 to provide an auger flight for transverse removal of cut coal. This novel structure enables simultaneous cutting and transferring of coal particles for collection by a standard floor supported conveyor.

With reference to FIG. 3 in detail, the cutter head 20 is supported to end 22 of the boom 16 by a gear assembly 52 that is fixed to surface 50 of the boom. A crank 54 journalled to the sides of boom 16 extends into the gear case 52 at opening 56. The crank 54 is keyed at 58 to the end gear 48 of a series of corresponding idler gears such as 48*a* coupled together between the opposite ends of boom 16. Eccentric portion 54*a* of the crank 54 extends into an opening 60 within the gear case 52 that is large enough to permit the eccentric portion 54*a* to rotate freely. A pinion gear 62 rotatably mounted on the eccentric portion 54*a* of crank 54 is located within a large circular opening 64 formed in gear case 52 immediately adjacent cover plate 66.

Formed to the inner surface 68 of the gear case 52 is a ring gear 70 having inner teeth 72 in mesh with outer teeth 74 on the pinion 62. Preferably, the gear ratio of the ring gear 70 to the pinion gear 62 is 4:3 so that every 4 revolutions of the crank shaft 54 will cause the pinion gear 62 to make 3 revolutions.

The cutter head 20 is fixed to one surface 76 of pinion gear 62 through an intermediate mount 78 so that the cutting path of the head is identical to the eccentric trajectory of the pinion 62 when rotated by crank shaft 54.

During energization of motor 46, which may be an hydraulic motor or other suitable type, the cutter head 20 is rotated by idlers 48 about the axis of the eccentric portion 54*a* of crank 54 in such a manner that the head follows an eccentric ellipse and the tip of each cutting bit 36 follows a square path defined by straight lines (FIG. 5) except for slight radii at the corners, where there are transitions of motion between the vertical and horizontal portions of the path. With the cutter head rotating clockwise as viewed from the end shown in FIG. 6, linear cuts into the longwall face F are made downwardly between the roof and floor of the mine. The cutting path of one bit 36 is shown at the mine roof during its cutting cycle. The cutter bits mounted on any apex 30–34 of the triangular shaped rotary cutter head 20 follow a linear path along the face F during the rotary motion of ring gear 70 and pinion gear 62.

Figure 6:
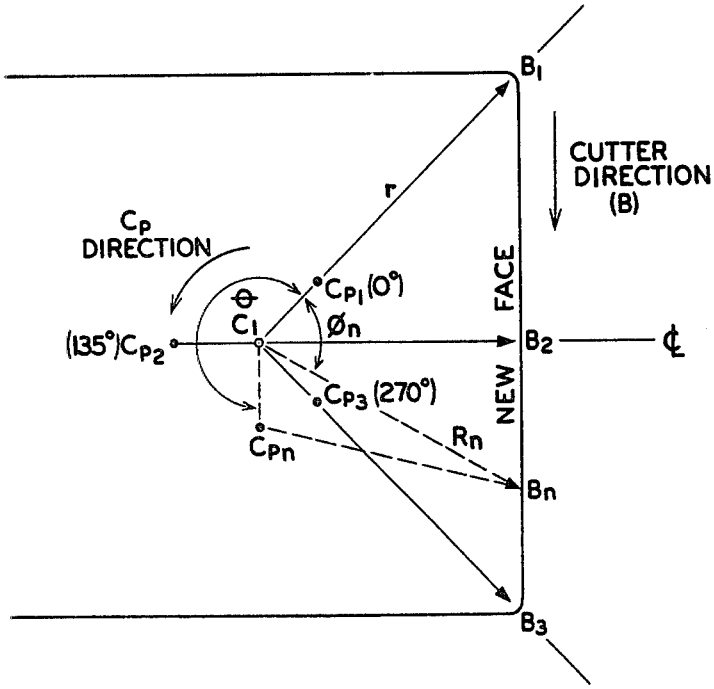
FIG. 6 is a diagram explaining the equations of motion describing the cutting path shown in FIG. 5 into the longwall face.

Considering now FIG. 6 in detail, the trajectory of the tip of each cutter bit 36 is identified by $B_n$. The center of ring gear 70, which coincides with the rotational axis of crank shaft 54, is identified by $C_I$. The cutter arm between the center of rotation of the pinion gear 62 and the tip of the cutter bits is identified by r. The angle swept by crank shaft 54 is defined by $\angle C_{P1}C_IC_{Pn}$ and is called $\theta$. The face cutting angle $\phi$ in similar notation is defined by $\angle B_1C_IB_n$.

The trajectory of the tip of each cutter bit 36 is thus defined by the following equations:

$$R = \sqrt{E^2 + 2Er(\cos\theta\cos(\theta/3) - \sin\theta\sin(\theta/3)) + r^2} \quad (1)$$

where E=the eccentric length of $\frac{1}{8}$ length of pitch diameter of ring gear 70 ($C_I$), and the remaining parameters are as defined above; and $$\phi = \sin^{-1}\frac{E\sin\theta - r\sin(\theta/3)}{R} + \frac{\pi}{4} \quad (2)$$

where $r=f(E)$, such that $r=7.467E$.

From the above, it is clear that one complete square cutting path for any bit 36 will be described by $6\pi$ radians for the angle $\theta$. It is also clear that the distance R reaches a maximum at top ($B_1$) and the bottom ($B_3$) corners of the cut where the eccentric portion 54*a* of crank shaft 54 at ($C_I C_{p1}$) is at zero degrees ($C_{p1}$) and 270 degrees ($C_{p3}$). A minimum distance (R) is obtained at the horizontal center line of head 20 ($B_2$), when the eccentric arm ($C_I$, $C_{p2}$) is at 135 degrees ($C_{p2}$). Thus, $B_n$ can be plotted for any angle $\theta$ at $C_{pn}$ to develop the cutter trajectory shown in FIG. 5.

Figure 5:
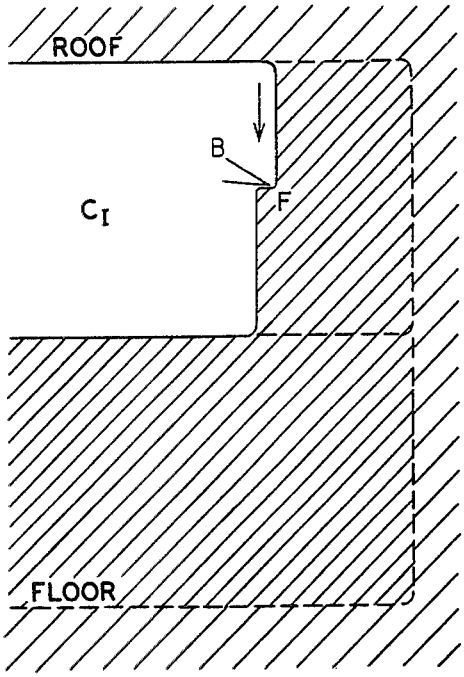
FIG. 5 is a diagrammatic view of the cutting path of the cutter head shown in FIG. 1 during machine operation.
Figure 7:
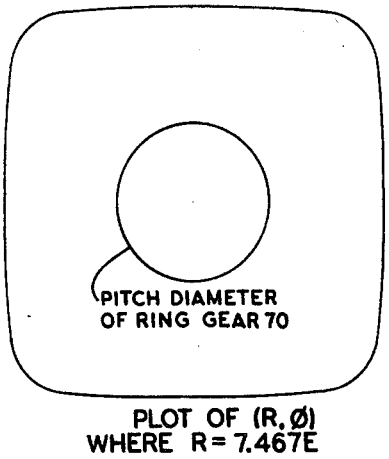
FIG. 7 is a graph showing the full path of the cutter head for r=7.467E.

If the two-dimensional representations of FIGS. 5–7 are visualized as being three-dimensional into the plane of the sheet of drawings, it is clear that the cutter head 20, by carrying a number of cutter bits 36 suitably spaced at the apexes of the helix 28, will make three-dimensional box shaped cuts into the longwall face F. It is recognized that the equilateral triangular cutting head shown in U.S. Pat. No. 4,012,077 is also capable of making three-dimensional box shaped cuts into coal. An important distinction between the patented head and the head 20 of the present invention, however, is that the cutter bits 36 are formed on the apexes of a helix or auger 28 in the invention to provide simultaneous conveying and cutting of coal, as shown in FIG. 2.

Thus, a longwall miner machine 10 has been provided in accordance with the invention with a linear cutting rotary head 20 cantilevered from boom 16 into longwall L and operated to make linear cuts into the face F. The linear trajectory of the cutter bits 36 substantially reduces generation of coal dust, and the novel helical structure of the approximately equilateral triangular shaped head provides simultaneous cutting and transverse movement of the coal to a conventional, floor supported conveyor 24. Also, because motor 46 is located at the base of boom 16 rather than at end 22 as in U.S. Pat. No. 4,012,077, to be coupled to the head 20 through idlers within the boom, loading of the boom is advantageously redistributed.

In this disclosure, there is shown and described only the preferred embodiment of the invention, but, as aforementioned, it is to be understood that the invention is capable of use in various other combinations and environments and is capable of changes or modifications within the scope of the inventive concept as expressed herein. For example, although the end view of the helix 28 is shown in the preferred embodiment as being in the shape of a Realeaux triangle, other species of equilateral triangle wherein the sides are in other forms of conic sections may be provided to be compatible with particular gear sizes and head sizes needed for the longwall face being cut. Also, auxiliary fragmentation subsystems, such as thermal heaters, hydraulic impact rams, electromagnetic heating, mechanical impact, high pressure liquid jets or any combination thereof may be placed at the cutter bits 36 within the spirit of the present invention.

We claim:

1. A longwall mining machine comprising:

a chassis movable parallel to and adjacent the longwall to be mined;

a boom pivoted at one end thereof to said chassis for movement of said boom in a vertical plane with respect to said chassis;

the opposite end of said boom carrying a rotatable cutting head with a longitudinal axis extending outwardly from the boom, said axis being, in an operative mode, generally parallel to the mining face to be cut and generally perpendicular to the direction of movement of the chassis;

said cutting head also comprising auger means cantilevered to one side of said boom and extending, in an operative mode, in the same direction as the longitudinal axis to engage the longwall, a helical portion of said auger means having an approximately equilateral triangular configuration with cutter bits being located on each of the apexes of said head;

means for rotating said cutting head about its longitudinal axis; and means for moving said cutting head during rotation thereof such that its apex bits outline a substantially square trajectory normal to the longitudinal axis of said head;

whereby cut coal is removed laterally from said longwall in the direction of the head's longitudinal axis towards the chassis by said auger during the rotation of the cutting bits of said head.

2. The mining machine of claim 1, wherein said head rotating means includes a motor mounted adjacent said one end of said boom, and means for coupling together an output of said motor and said cutting head.

3. The mining machine of claim 2, wherein said coupling means includes a plurality of idler wheels extending between said motor and said cutter head within said boom.

4. The mining machine of claim 1, wherein said moving means includes a crank arm mounted for rotation about an axis parallel to the axis of rotation of said cutter head, said crank arm having an eccentric portion; pinion means mounted to said eccentric portion for rotation about the crank axis; a ring gear concentric to the crank axis, said ring gear having internal gear teeth in mesh with gear teeth of the periphery of said pinion means, said cutter head being mounted to said pinion means for eccentric rotation relative to the crank axis.

5. The mining machine of claim 1, including conveyor means parallel to and adjacent said longwall for conveying coal removed from said longwall by said auger means.

* * * * *